United States Patent [19]

Allard et al.

[11] 4,019,215

[45] Apr. 26, 1977

[54] METHOD AND APPARATUS FOR LINING SAFETY BOX TOES

[75] Inventors: Jules N. Allard, Tyngsboro; Victor J. Gagnon, Salem, both of Mass.

[73] Assignee: Bush Universal, Inc., Woburn, Mass.

[22] Filed: Apr. 19, 1976

[21] Appl. No.: 678,244

[52] U.S. Cl. ..... 12/146 D; 12/61 A; 12/64; 36/77 R

[51] Int. Cl.[2] ..... A43D 7/00; A43D 65/00; A43C 13/14

[58] Field of Search ..... 12/146 D, 52, 61 R, 12/61 A, 61 B, 64, 54.2; 36/46.5, 77 R, 77 M

[56] References Cited

UNITED STATES PATENTS

| | | | |
|---|---|---|---|
| 1,600,967 | 9/1926 | Ayer | 12/64 |
| 2,391,445 | 12/1945 | Cohen | 36/46.5 |
| 3,100,902 | 8/1963 | Leammon | 12/146 D |
| 3,618,151 | 11/1971 | Becker | 12/146 D |

*Primary Examiner*—Patrick D. Lawson
*Attorney, Agent, or Firm*—Wolf, Greenfield & Sacks

[57] ABSTRACT

A rigid box toe piece for use in the assembly of a lasted safety shoe is lined in a machine which shapes the liner and attaches it to the inner surface of the steel box. The machine includes a clamp to temporarily hold the positioned box liner with respect to a mold which is shaped to correspond to the toe end of a last. The steel box is placed over the clamped liner and a press then urges the steel box over the liner and onto the mold to press and shape the liner between the box and the mold. The liner is secured to the steel box by adhesive which is applied to the inner surface of the box before the box is placed in the machine so that the pressing step also bonds the liner to the box. The machine includes means for aligning the liner with respect to the mold.

28 Claims, 20 Drawing Figures

METHOD AND APPARATUS FOR LINING SAFETY BOX TOES

BACKGROUND OF THE INVENTION

This invention relates to a method and apparatus for lining the inner surface of a safety box toe piece, made from steel or other appropriate rigid material, before the box is incorporated into the shoe assembly.

It usually is desirable in the manufacture of lasted safety shoes having steel box toes to provide a liner (sometimes referred to as a "sock saver") over the inner surface of the steel box. The box liner may be made from leather, fabric, or other suitable materials. The liner should provide a comfortable feel inside the shoe and preferably should insulate (both thermally and electrically) the steel box from the wearer's foot. The liner should conform to the shape of the inner surface of the steel box to avoid uncomfortable wrinkles. Depending on the material selected for the liner, this may not be a simple task because of the compound curvature of the inner surface of the box. Typically, the proper lining of the toe box is a difficult procedure requiring considerable skill. It is among the general objects of the invention to provide a method and apparatus which greatly simplifies the procedure of lining the box.

In addition to simplifying the procedures heretofore employed in lining of steel box toes, the invention also is usable in connection with an invention relating to the manufacture of safety shoes having rigid box toes as described in U.S. patent application Ser. No. 652,174 filed Oct. 23, 1975 and entitled "Manufacture of Safety Shoes Having Rigid Box Toes". Briefly, the invention described in that application relates to a procedure in which the steel box toe piece is attached to the upper assembly before the upper is placed on the last. The box may be attached to the upper by a number of procedures, some of which include preliminarily lining the inner surface of the box toe with a liner which extends rearwardly beyond the tip line of the box and then attaching the rearwardly extending portion of the liner assembly to the upper. It is important to locate the box toe at a proper position with respect to the liner. The present invention also includes an arrangement by which the box can be located properly with respect to the liner which enables the lined box to be properly positioned with respect to the upper assembly.

SUMMARY OF THE INVENTION

The invention employs a last-like mold having a toe end which conforms to the shape of the toe end of the last on which the shoe is to be pulled over and lasted. The steel box is of a shape and contour which corresponds to the shape, contour and size of the toe mold. The box liner is placed on top of the toe mold and is positioned with respect to the toe mold with the aid of one or more gaging devices incorporated into the machine. A clamp then is urged downwardly toward the toe mold to temporarily secure the liner in its aligned position on the toe mold. The steel box, which has been coated on its inner surface with an appropriate adhesive, then is placed over the toe end of the toe mold in overlying relation to the liner. With the liner and box so positioned, a pressing mechanism incorporated into the machine advances downwardly to engage the toe box and to progressively urge the box downwardly and rearwardly over the liner and mold. The engagement of the lower edge of the toe box stretches and wipes the liner to conform it to the shape of the mold and sandwiches it between the toe box and the toe end of the mold. The wiping action effected by the lower edge of the toe box smooths out wrinkles progressively as the toe box is urged downwardly and about the mold. The liner thus is pressed into smooth and continuous engagement with the inner surface of the toe box and adheres to the inner surface of the toe box by the adhesive coating on the inner surface of the toe box. In one embodiment of the invention the press has an inclined plate which engages the toe box. The inclined attitude of the plate urges the toe box both downwardly and heelwardly. In another embodiment of the invention, the toe press includes a scissors-like device having a pair of members, one of which serves to urge the toe box downwardly and the other of which thereafter urges the toe box rearwardly. In a further embodiment of the invention the toe press urges the toe box primarily in a downward direction and, after the toe press has urged the toe box fully down against the toe mold, a second press is urged in a heelward direction against the toe end of the toe box to insure that the toe box is fully seated about the toe mold with the box liner fully and intimately sandwiched between the mold and the toe box.

It is among the objects of the invention to provide an improved method and apparatus for lining a rigid box toe piece.

Another object of the invention is to provide a method and apparatus for lining the inner surface of a rigid toe box in which the liner is free of wrinkles and is in full, continuous and intimate bonded contact with the inner surface of the toe box.

A further object of the invention is to provide an improved device for properly locating the toe box and box liner with respect to each other.

Another object of the invention is to provide a device of the type described in which the liner is wiped and stretched to shape about a mold before it is secured to the inner surface of the toe box.

Still another object of the invention is to provide a method and apparatus of the type described which is relatively inexpensive and is easy to utilize.

DESCRIPTION OF THE DRAWINGS

The foregoing and other objects and advantages of the invention will be understood more fully from the following further description thereof, with reference to the accompanying drawings wherein.

DESCRIPTION OF THE PREFERRED EMBODIMENTS

Figure 1:
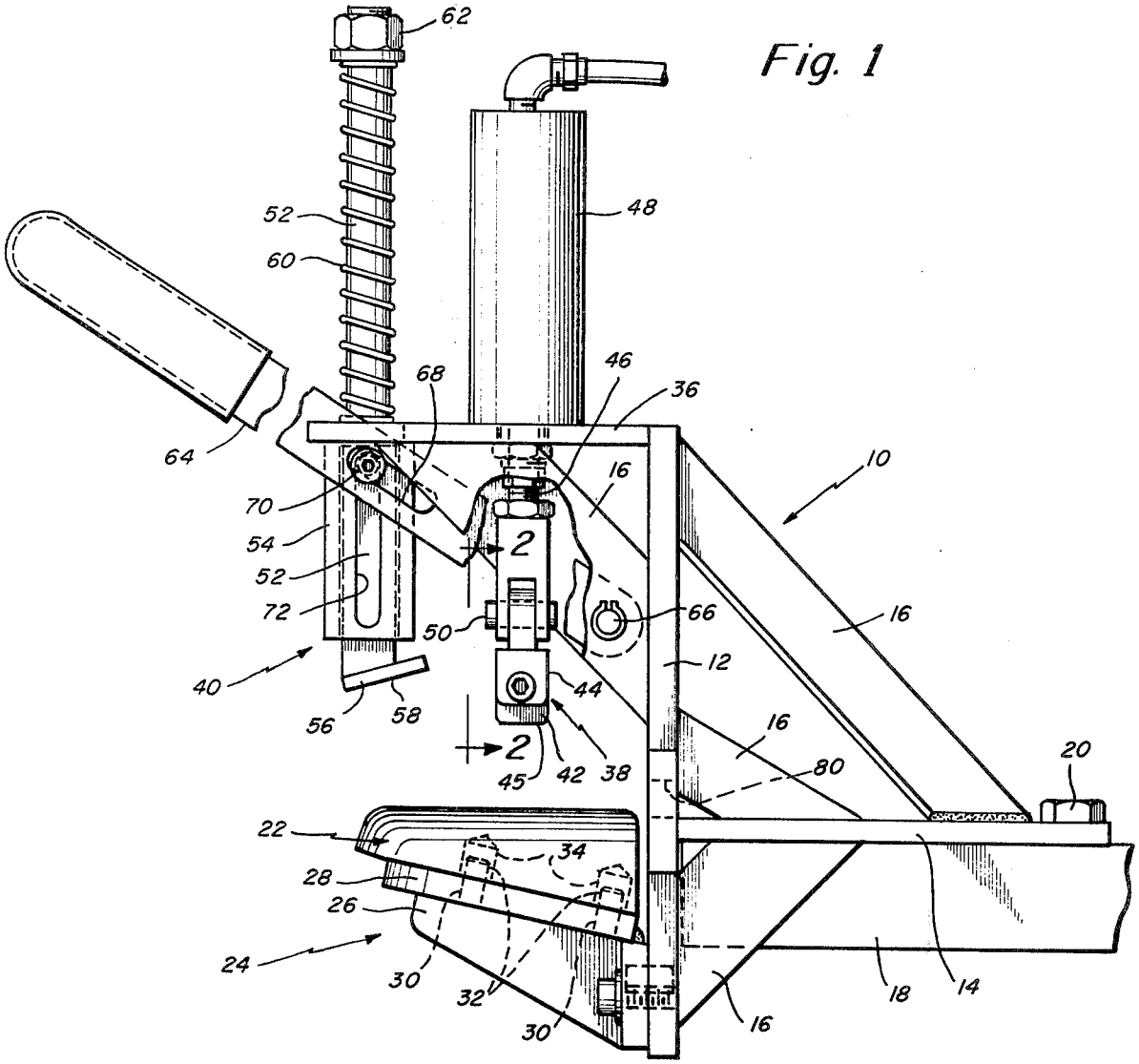
FIG. 1 is a side elevation of one embodiment of the machine.

As shown in FIGS. 1–4, the machine includes a frame indicated generally by the reference character 10, which includes a vertical central member 12. A generally horizontal table 14 is secured to and extends rearwardly from the central member 12. The frame includes a number of braces 16 to secure these parts together in a rigid configuration. The frame 10 may be secured to a suitable support 18, for example, by bolts 20 or other suitable means.

A mold 22, which is shaped generally to correspond to the toe and forepart portion of a last, is detachably mounted on a mold platform, indicated generally at 24, which is secured to and extends forwardly from the lower region of the central member 12. The mold platform 24 is in the form of a generally T-shaped support bracket having a forwardly extending portion 26. A mold support plate 28 is secured to the bracket and extends forwardly beyond the end of the forward portion 26. The mold platform 24 is preferably arranged so that the mold support plate 28 is inclined somewhat downwardly and rearwardly as shown in FIG. 1. The mold 22 is detachably mounted to the mold support plate 28 by a pair of spaced pins 30 which are secured to and extend upwardly from the mold support plate and which are received in similarly spaced holes 32 formed in the bottom of the mold 22. The holes 32 preferably are formed in metal bushings 34 which are secured and are embedded in the underside of the mold 22. The pins 30 and holes 32 are perpendicular to the plate 28 and extend upwardly and rearwardly as shown.

The mold 22 may be cut from a last and is formed to have a flat bottom to rest flush on the support plate 28. The peripheral dimension of the plate 28 is smaller than that of the mold so that the edge of the mold overhangs the support plate 28. The remaining portions of the toe end of the mold 22 (over which the toe box 23 will be placed) are of substantially the same configuration as the last from which it is made. The more rearward portion of the mold is modified from the conventional last shape in that it is cut down so that the top surface, along the centerline, of the mold is substantially straight and horizontal when the mold is seated on the support plate 28. It may be noted that only about five pairs (right and left) of such molds will be required in the use of the machine because in the manufacture of steel box safety shoes it is common practice to use special lasts in which the toe ends of the lasts are formed in one of five sizes, each size being considered sufficient to satisfy a selected range of shoe sizes. The result is that it is only necessary to stock five sizes of box toe pairs.

Figure 2:
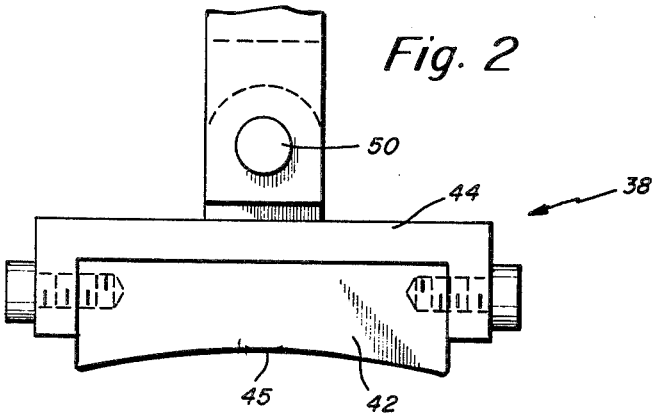
FIG. 2 is an enlarged front elevation of the clamp pad as seen from the line 2—2 of FIG. 1.
Figure 3:
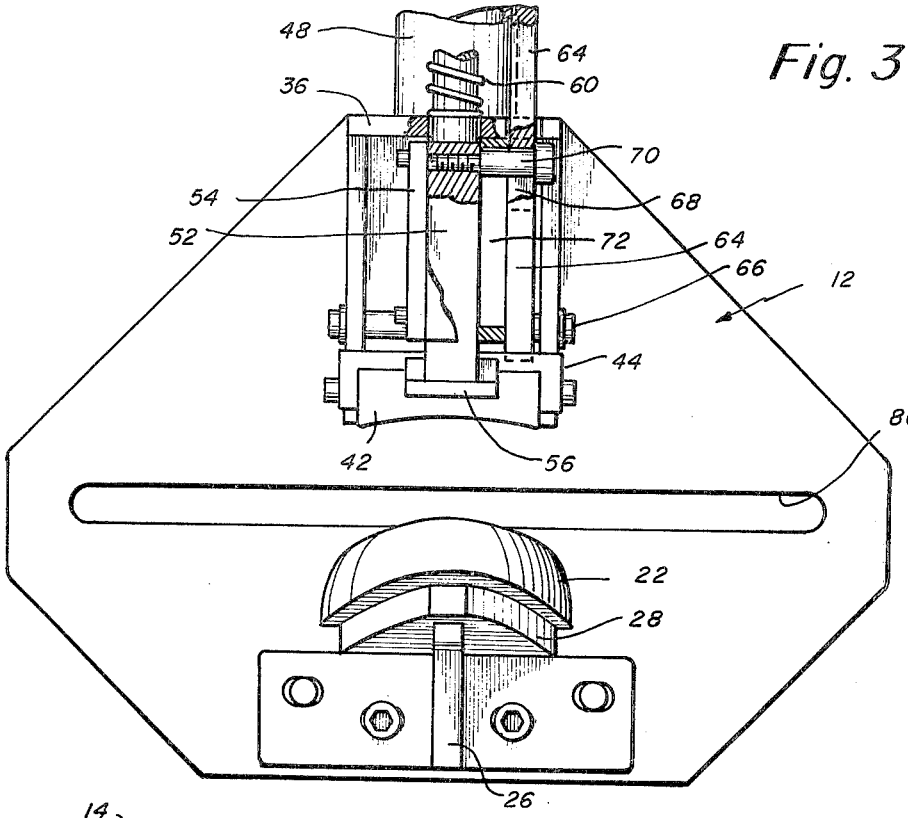
FIG. 3 is a front elevation of the machine shown in FIG. 1.

The machine includes an overhead support bracket 36 which extends forwardly from the upper portion of the central plate 12, above the mold platform 24. The overhead support bracket 36 carries a clamp, indicated generally at 38 and a press, indicated generally at 40. The clamp 38 includes a flexible, resilient clamping pad 42 which is carried by a pad bracket 44. The pad bracket 44, in turn, is pivotally suspended from the end of a piston rod 46 of a pneumatic cylinder 48 which is secured to the overhead support bracket 36. The pad bracket 44 preferably is mounted so that it may pivot only about a forwardly-rearwardly extending axis as suggested by the pivot pin 50. From the foregoing, it will be seen that the pad 42 is movable vertically toward and away from the mold 22 under the influence of the pneumatic cylinder 48. The clamp 38 is mounted to the overhead support bracket 36 in a position which will cause the pad 42 to move toward and away from the more rearward region of the mold 22, that is, that portion of the mold 22 which will not be covered by the steel box toe piece when the steel box is in place on the mold 22, as will be described. The lower surface 45 of the pad may be curved as shown in FIG. 2 to facilitate uniform clamping pressure of the liner to the mold.

The press 40 is secured to the overhead support bracket 36 forwardly of the clamp 38 and is movable vertically toward and away from the toe end of the mold 22. In the embodiment shown in FIGS. 1–6, 8 and 9, the press 40 includes a vertically movable rod 52 which extends through and is guided by an elongate housing 54 which, in turn, is secured to and extends downwardly from the overhead support bracket 36. A pressing plate 56 is secured to the lower end of the rod 52 and includes a lower surface 58 which is inclined upwardly and rearwardly. The rod 52 is biased in an upward position shown in FIG. 1, for example, by a spring 60 which surrounds the upper end of the rod 52 and is retained at its lower end by the support bracket 36 and at its upper end by a nut and washer assembly 62 secured to the upper end of the rod 52. In the embodiment shown in FIGS. 1, 2 and 4, the press is operated manually by a handle 64 which is pivoted at its rear end, at pivot 66 to the frame 10. The handle 64 has a longitudinal slot 68 formed along its midportion which receives a roller 70. The roller 70 is secured to the rod 52 and extends from the side of the rod through a vertical slot 72 in the housing 54. Powered means for actuating the press may be employed in lieu of the handle 64, if desired.

FIGS. 4–9 illustrate the manner in which the foregoing embodiment of the machine is used to attach one type of box liner to the steel box in accordance with the invention. It is illustrated as being employed with a type of liner assembly shown in phantom in FIG. 4 and which is described in my aforementioned copending patent application. That liner assembly, for example only, may include a forward flexible leather sock-saver portion 74 at its toe end, which has been stitched to a precut vamp liner 76 which may be made from cotton duck, leather or other suitable vamp lining material. In some instances the entire box and vamp lining assembly may be made from a single piece of leather or other material if desired. It should be noted that in this type of liner assembly, the rear edge 78 will have been precut and shaped so that it may be subsequently sewn directly to the similarly shaped rear edge of the vamp portion of the upper.

Figure 4:
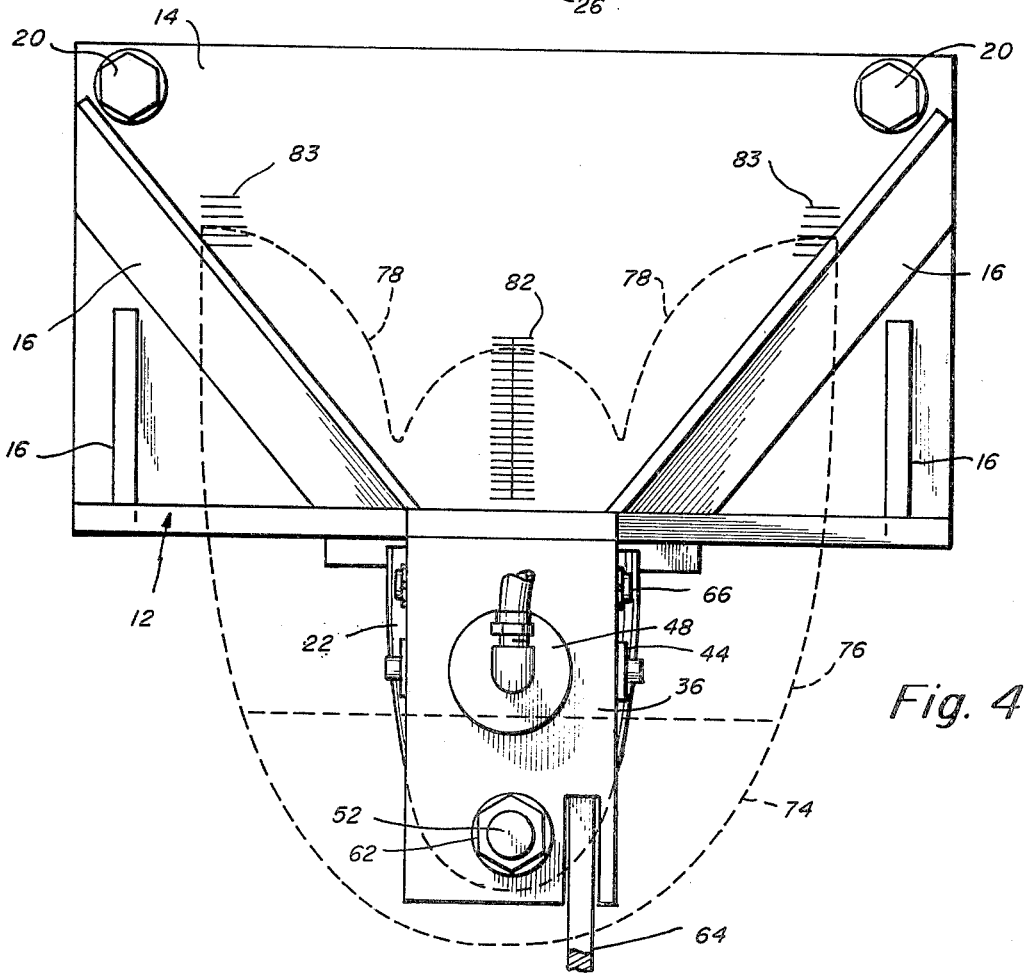
FIG. 4 is a plan view of the machine shown in FIG. 1.

It is important to locate the steel box in a proper longitudinal position with respect to the liner assembly. To this end, the embodiment shown in FIGS. 3 and 4 may include a transversely extending slot 80 in the central member 12 which enables the more rearward portion of the liner assembly to pass rearwardly through the slot 80 and lie on the table 14 and with the more forward portion of the liner assembly resting on top of the mold 22 (FIG. 4). In order to facilitate proper positioning of the liner assembly with respect to the mold 22 (and, therefore with respect to the toe piece when the toe piece is applied) a calibrated scale 82 may be formed on the surface of the table 14. The rear edge 78 of the liner assembly is aligned with the appropriate marking on the central portion of the scale 82 in order to position the liner assembly longitudinally and the more laterally disposed portions of the rear edge of the liner assembly can be aligned with more laterally disposed transverse lines 83 to orient the liner assembly in the proper angular position with respect to the mold 22.

Figure 5:
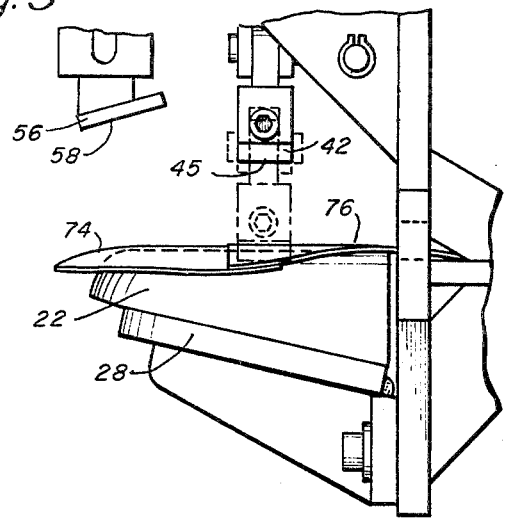
FIG. 5 is an illustration of the machine with a liner clamped in place.

With the liner assembly properly positioned with respect to the mold, the cylinder 48 is actuated to clamp the liner assembly to the upper surface of the mold 22 (FIG. 5). As mentioned, the clamp 38 is located so that it will engage the liner at a location behind the area which will be covered by the steel box so as not to interfere with the placement or attachment of the steel box. With the liner assembly clamped in place, the steel box 23 (which has been coated on its inwardly facing surface with a suitable adhesive) then is placed over the toe portion 74 of the liner and toe end of the mold 22.

Figure 6:
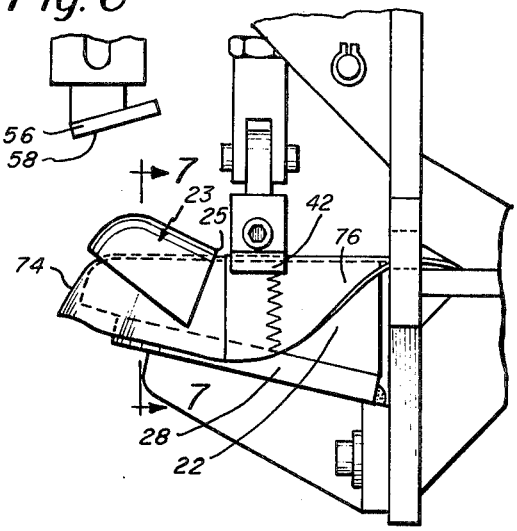
FIG. 6 is an illustration similar to FIG. 5 showing the manner in which the steel box is initially placed over the toe mold and liner.
Figure 7:
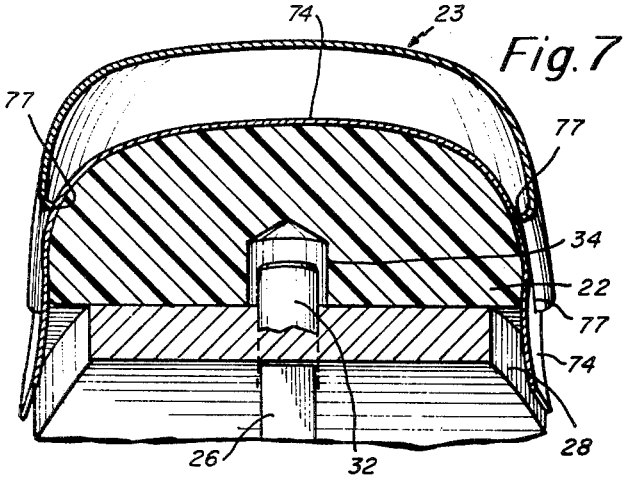
FIG. 7 is a sectional elevation as seen along the line 7—7 of FIG. 6.

As shown in FIGS. 6 and 7, the toe box 23 preferably is placed in a forwardly and upwardly inclined attitude, with its rear edge 25 (the tip line) in engagement with and surrounding the liner but with its more toeward portions inclined as shown. When so positioned, the inner edges 77 of the inwardly extending lip 79 at the bottom of the toe box will engage the liner and hold the liner against the sides of the mold 22. With the box toe piece 23 in this position, the press 40 is actuated to urge the press plate 56 into engagement with the box toepiece 23. As mentioned, the press plate 56 engages the box toepiece by its lower surface 58 which is inclined at an angle which will tend to rotate the toe end of the toe box downwardly while also imparting a rearward force to the toe box. As the toe box is rotated in this manner, the inner lateral edges 77 of the inwardly extending lip will tend to wipe the liner 74 downwardly against the sides of the mold 22 and, as the toe box approaches a fully assembled position, the more toeward portion 79 of the inner edge of the box lip engages the more toeward portions of the liner (see FIG. 8) to wipe and slightly stretch the liner into conformity with the shape of the toe end of the mold 22. As the box is rotated fully to its fully seated position (FIG. 9) in which its lip 77, 79 just passes below the underside of the mold 22, it then snaps fully and rearwardly (heelwardly) over the toe end of the mold 22 to fully and completely engage the entire wiped and stretched liner and to adhesively bond the toe box to the liner. The foregoing wiping and pulling is effective to conform and sandwich the liner to the shape of the mold without any wrinkles and the liner is bonded to the liner surface of the toe box in that configuration. The press 40 may continue to apply pressure to the box for a short interval after the toe box has snapped into place to insure a firm and good adhesive bond. The press and clamp then may be released and the lined steel box may be removed. The resulting assembly is one in which the box liner is free of wrinkles, conforms precisely to the configuration of the inner surface of the toe box and is continuously and intimately bonded to the inner surface of the toe box. It may be noted that the upwardly and forwardly inclined attitude of the mold support plate 28 and the similarly inclined attitude of the bottom surface of the mold in cooperation with the force of the clamp 40 to insure that the mold 22 will not be displayed in response to the action of the press.

Depending on the shape in which liner assembly was initially cut, there may or may not be excess liner material protruding from between the lip of the toe box and the mold 22. Any such excess can be trimmed off.

Figure 10:
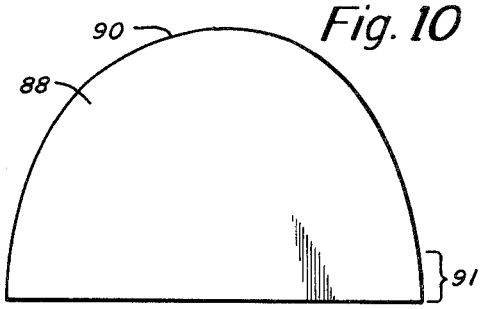
FIG. 10 is a plan illustration of another type of box liner.
Figure 8:
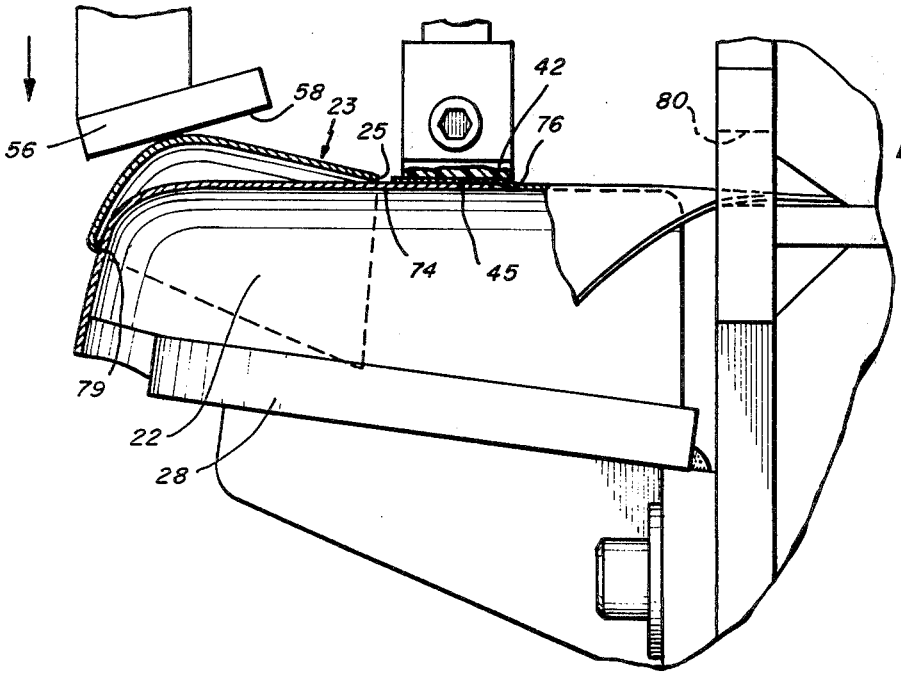
FIG. 8 is an enlarged sequential illustration showing the steel box partly urged toward its fully down position.
Figure 9:
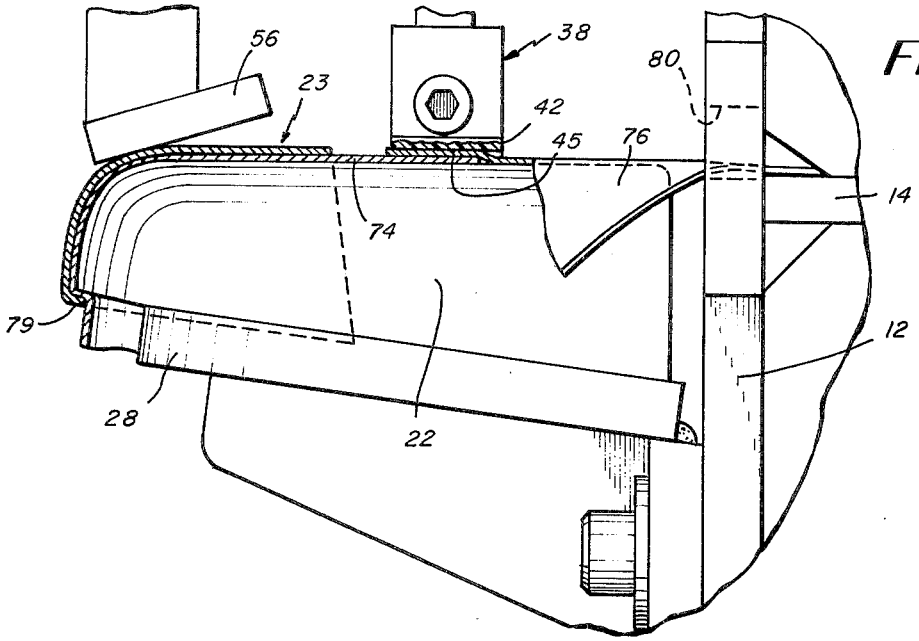
FIG. 9 is an illustration of the steel box after it has been fully pressed to the toe mold.

As mentioned above, the present invention may be employed in the lining of steel box toe pieces other than in an environment which employs the invention described in my aforementioned U.S. patent application. For example, where it is desired to line a steel box for use in more conventional shoe manufacture procedures, the box liner 88 may be of the abbreviated configuration shown in FIG. 10 in which there is no substantial rearwardly extending liner portion. The liner should have some excess material 91 at the rear region so that it can be clamped by the clamp 38. With such a liner, it is preferred to orient the liner with respect to the mold 22 with reference to the forward edge 90 of the liner. In order to facilitate proper positioning of such a liner on the mold 22, a toe gauge 92 may be mounted to the mold platform 24. The spacing of the toe gauge toward and away from the toe end of the mold 22 can be adjusted for the various sizes. The toe gauge has a rearwardly extending pin 94 which is slidably received in a bore 96 in the mold support plate 28. The lower end of the toe gauge 92 is bifurcated to define a slot 98 which is surrounded by a recessed shoulder 100. The slot 98 and shoulder 100 receive an enlarged portion 102 of a screw 104, by engagement with an annular slot 106 formed in the enlarged portion 102. The rearwardly extending end of the screw 104 is received in a threaded bore 108 formed in the forwardly extending portion 26 of the mold platform 24 and the screw 104 is rotated manually by a knob 110 which protrudes forwardly of the toe gauge 92. Thus, the relative longitudinal position of the toe gauge with respect to the mold 22 can be adjusted by rotation of the screw. If desired, the pin 94 may be provided with appropriate graduations 112 corresponding to various shoe sizes. The upper end of the toe gauge 92 preferably is formed to define a transverse shoulder 114 on which the most forward edge 90 of the liner can rest. If desired, a forwardly-rearwardly extending slot 116 or other suitable mark may be formed to facilitate lateral positioning of the liner. With the liner 88 in proper position, the clamp 38 is actuated and the operation of the machine in the procedure employed is the same as described above.

Figure 11:
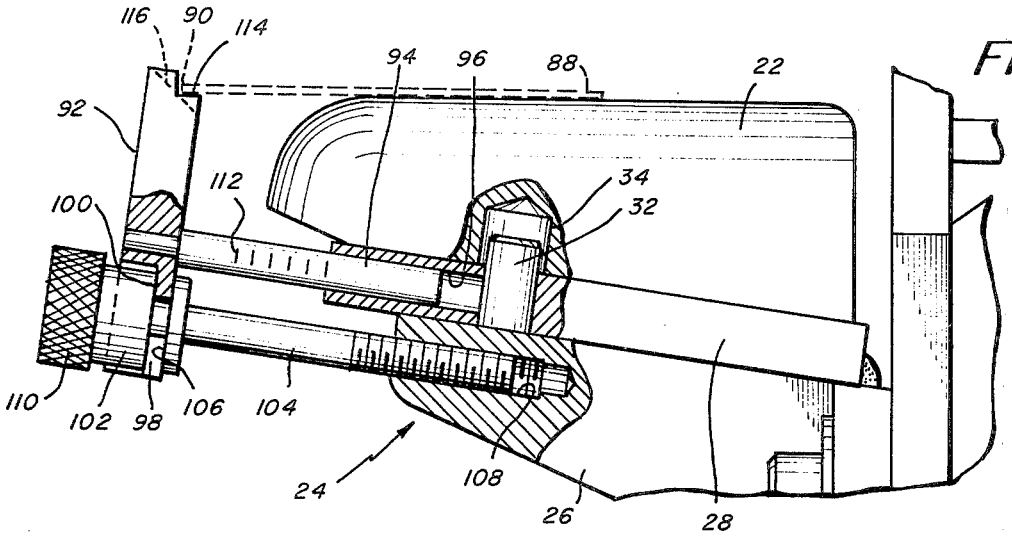
FIG. 11 is a side elevation of the machine of FIG. 1 modified to include a toe gaging device for use with the liner shown in FIG. 10.
Figure 12:
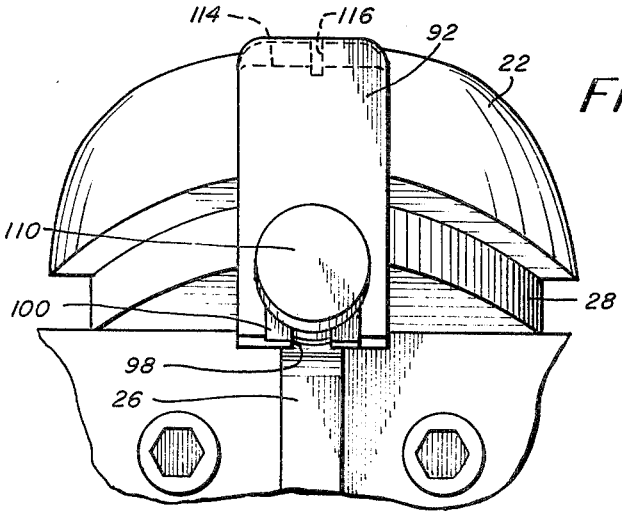
FIG. 12 is a front elevation of the device shown in FIG. 11.
Figure 13:
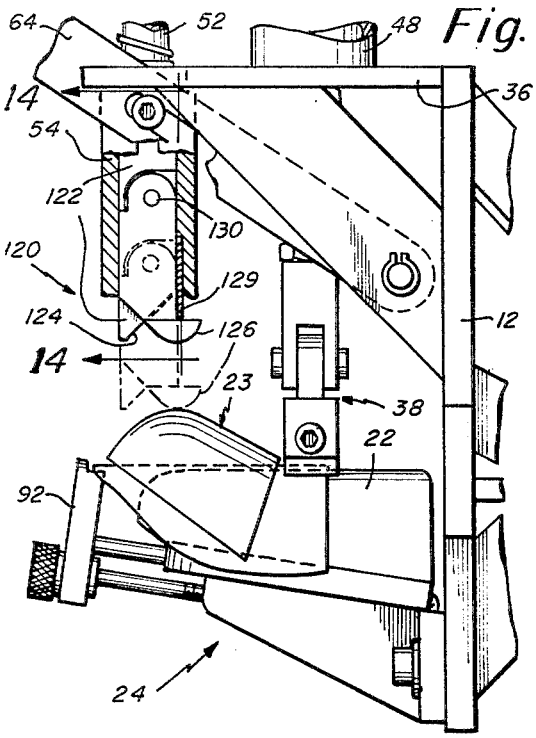
FIG. 13 is a side elevation of another embodiment of the machine having a modified toe press.
Figure 14:
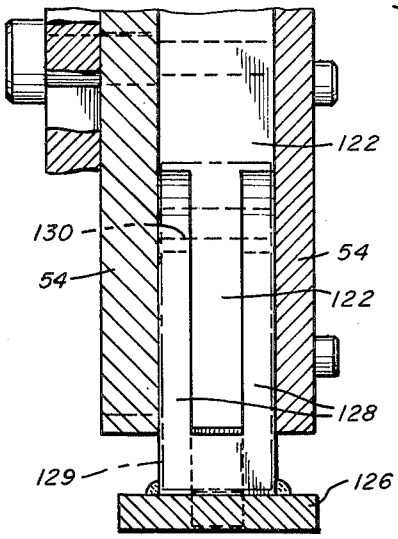
FIG. 14 is a sectional elevation as seen along the line 14—14 of FIG. 13.
Figure 15:
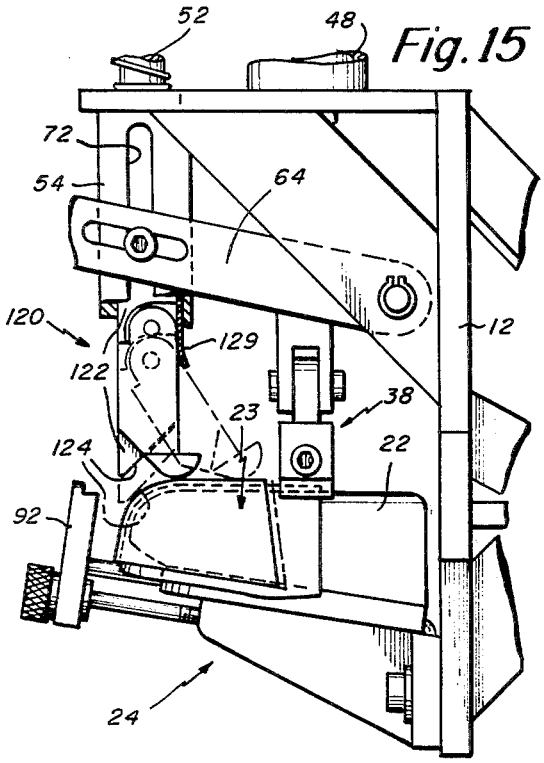
FIG. 15 is an illustration of the embodiment shown in FIG. 13 further illustrating operation of that toe press mechanism.

FIGS. 13–15 show another embodiment of the toe press indicated generally at 120. In the description of this embodiment of the press 120, the machine elements are otherwise the same as described above and like reference characters will refer to like elements of the previously described embodiment. Also, it may be noted that this embodiment is illustrated as being used in connection with the toe gauge 92 (FIGS. 11 and 12) although it is useable equally with the gauging arrangement shown in FIG. 4. In this embodiment the toe press 120 includes a downwardly projecting finger 122 which is integral with the lower end of the rod 52. The lowermost end of the finger has an upwardly and rearwardly inclined wedging surface 124 which, when it engages the toe box (as will be described) imparts a substantial wedging action to the toe box to urge the box heelwardly under a substantially greater force than is achievable with the less shallow angle of the inclined pressure plate 56 described in connection with the previous embodiment. The press arrangement 120 includes a second pressing element 126 which is attached to the lower end of a clevis 128. The clevis 128 is pivotally mounted to the finger 122, at pin 130 and embraces the lower end of the finger 122 shown in FIG. 14. Means are provided to bias the clevis 128 forwardly toward the finger 122, such as a leaf spring 129 mounted to the housing 54 and having a downwardly extending free end in engagement with the clevis 128. The clevis 128, lower end of the finger 122 and the housing 54 are arranged so that when the rod 52 is in its upper position (shown in solid in FIGS. 13 and 14) the substantial portions of the finger 122 and clevis 128 is retracted into the housing 54, thus confining the clevis 128 and precluding it from pivoting about pin 130. When the press 120 is operated to urge the toe box into engagement with the box liner on the toe mold, downward movement of the rod 52 will cause the finger 122 and second press element 126 to advance downwardly in unison to cause the press element 126 to engage the toe box as suggested in phantom in FIG. 13. The clevis 128 is, at this time, still confined within the housing 54 and cannot pivot about the pin 130. Continued downward movement of the rod 52 advances the finger 122 and press foot 126 to the position shown in solid in FIG. 15 in which the toe box has been urged to its full downward position with the lip 79 of the toe box disposed just below the level of the bottom periphery of the toe mold. At this time the assembly of the finger 122 and clevis 128 has advanced far enough out of the housing 54 so that the clevis 128 is free to pivot rearwardly about the pin 130 as suggested in phantom in FIG. 15. This permits further downward advancement of the toe press mechanism to bring the inclined wedging surface into engagement with the toe end of the toe box. Thereafter, a slight further downward movement of the finger 122 urges the toe piece heelwardly into snug and firm engagement with the toe mold and insuring a full and intimate contact of the box liner with the internal surfaces of the toe box, including the internal surface of the lip 79. The inclined wedging surface 124 of the finger 122 also imparts a downward force on the toe end of the box to keep it in its fully down position. The pressure foot 126 pivots as described, to the position suggested in phantom in FIG. 15 to engage the more rearwardly disposed portion of the toe box to help hold that portion of the toe box in its down position. The downward force exerted by the pressure foot 126, under the influence of leafspring 129 at this time is not very substantial although it is sufficient to preclude the heelward portion of the toe box from lifting up. Thus, in this embodiment of the toe press the downward and heelward motions are effected in sequence and in response to progressive advancement of the rod 52. The relatively sharp incline of wedging surface 124 insures that the heelward force will be substantial to insure a full and intimate engagement of the box liner with the toe box. In this regard, the wedging surface 124 preferably should be inclined at an angle of at least 45° to the horizontal.

Figure 18:
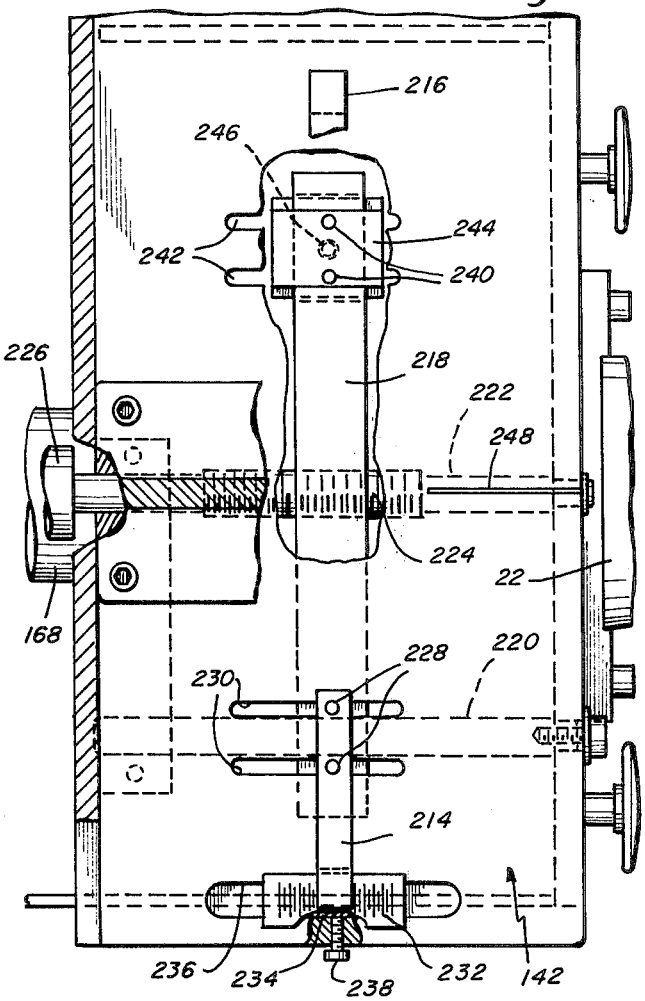
FIG. 18 is a plan view of the table as seen along line 18—18 of FIG. 16 and illustrating the adjustable means for orienting the box liner in a proper position.
Figure 16:
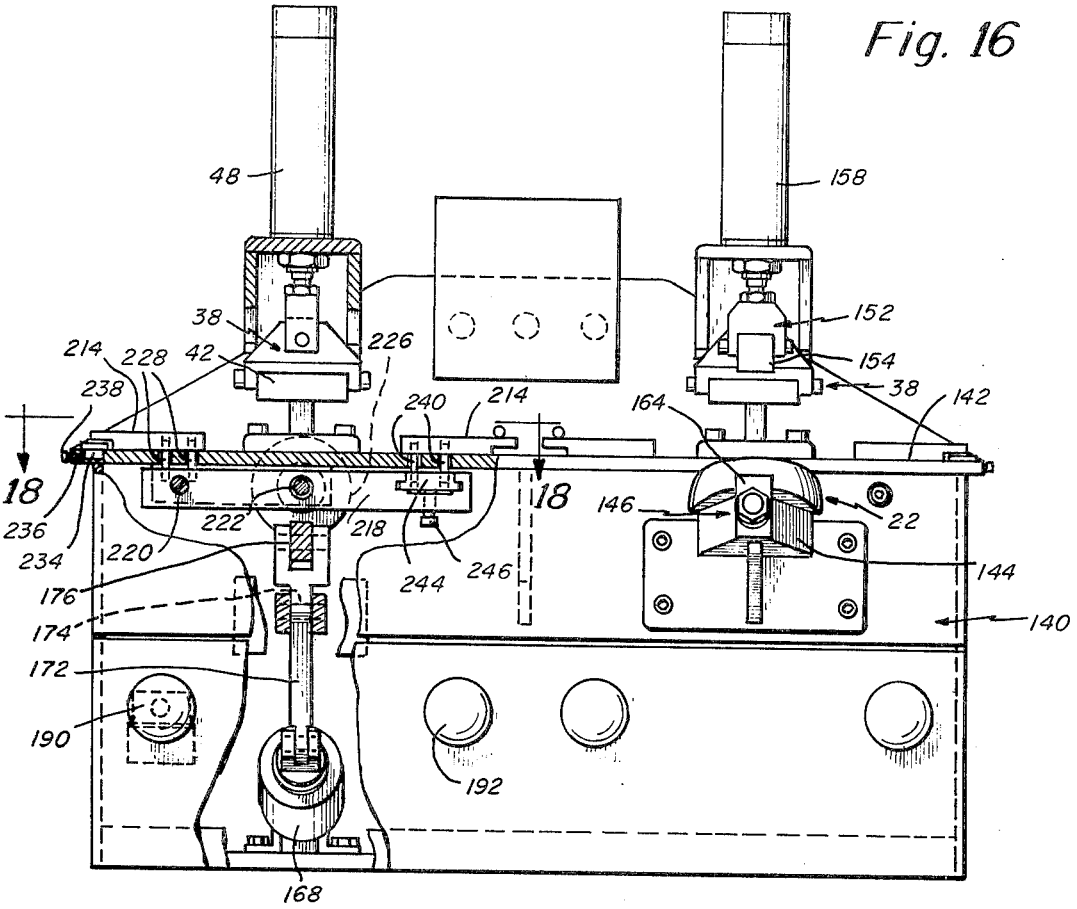
FIG. 16 is a partly broken away, front elevation of a two station machine employing still another embodiment of the invention.
Figure 17:
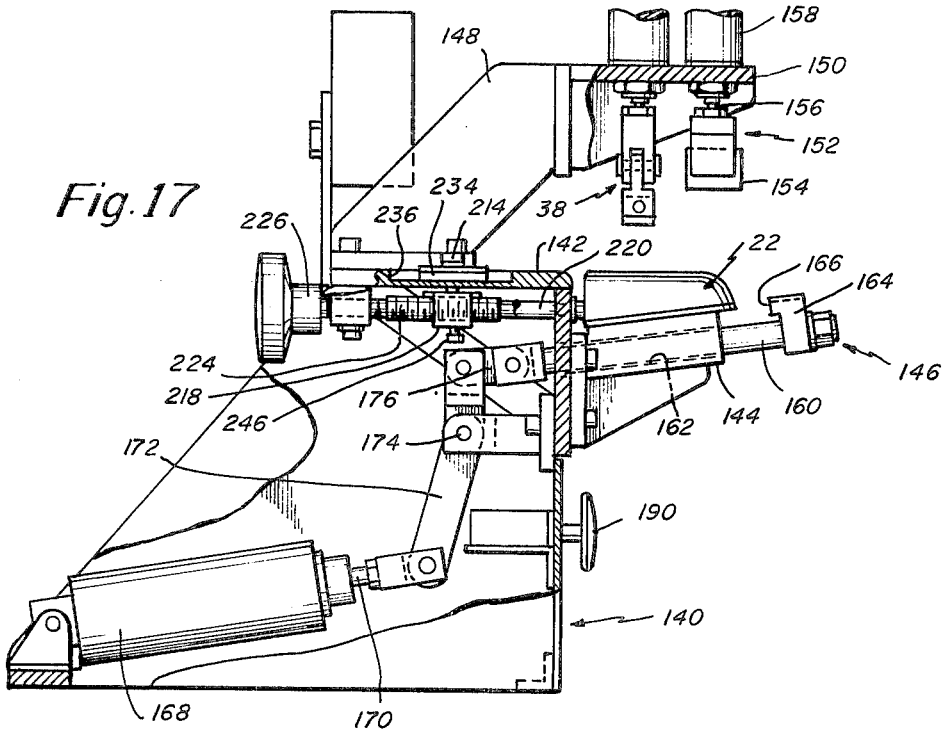
FIG. 17 is a partly broken away, side elevation of the embodiment of the invention shown in FIG. 16.

FIGS. 16–18 show still another embodiment of the invention in which the downward and heelward forces are applied to the toe box by separate devices controlled to operate in sequence. This embodiment is described as employed in a two station machine, each station being of identical construction to enable the operator to operate on a right and left pair of toe boxes at the same time. This embodiment of the invention also illustrates an improved gaging device which facilitates alignment of the box liner with the toe box to compensate for the slight but important angular differences between the foreparts of right and left shoe assemblies.

As shown in FIGS. 16 and 17, this embodiment includes a housing 140 which serves as a main frame. A table 142 defines the top of the housing 140. A pair of mold supports 144 are secured to and extend forwardly from the front of the housing and each supports a toe mold 22 in the same manner as in the embodiments described above. The mold supports 144 in this embodiment are of more substantial size than in the previously described embodiments so that they may serve as bearings for a toe hammer mechanism 146.

A rigid bracket 148 is secured to the table 142 at each of the stations and extends forwardly to define an overhead support 150 above the toe mold 22. The overhead support carries a clamping arrangement 38 which operates in the same manner and for the same purpose described above. The support 150 also carries a toe press, indicated at 152 which includes a pressing block 154. The pressing block 154 is secured to the downwardly extending of a piston rod 156 of a cylinder 158. In this embodiment of the invention the toe press 152 serves only to urge the toe box downwardly and imparts no substantial heelward force to the toe box. After the toe press 152 has urged the toe box to its full down position the toe hammer arrangement 146 is then operated to impact the toe box heelwardly and seat it fully on the toe mold. In order not to adversely hinder the heelward movement of the toe box, the pressing block 154 preferably is made from a material having a relatively low coefficient of friction such as teflon.

The toe hammer arrangement 146 includes a rod 160 which extends through a bore 162 in the mold support 144. The forwardly projecting end of the rod 162 carries an impact member 164 having a heelwardly facing impact surface 166 which will engage the lower region of the toe end of the toe box when the impact member 164 is urged heelwardly. The impact member 164 is operated by a cylinder 168 which is mounted to and inside the housing 140. The piston rod 170 of cylinder 168 is pivoted to one end of a lever 172 which, in turn, is pivoted to a stationary pivot 174 securely mounted with respect to the housing 140. The other end of the lever 172 is pivotally connected to the inwardly protruding end of the rod 160 by a connecting link 176.

Figure 19:
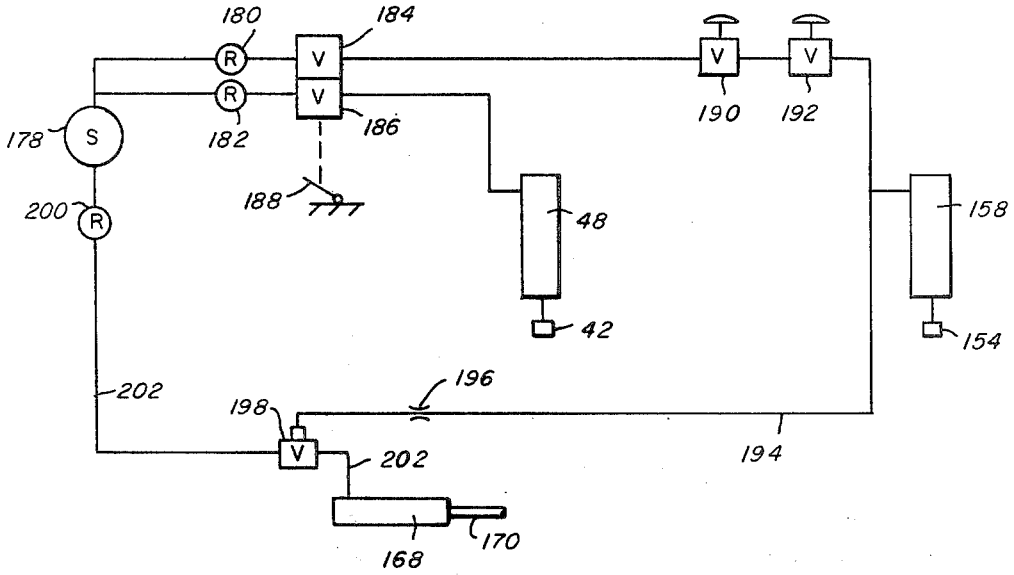
FIG. 19 is a diagrammatic illustration of the control mechanism for the machine shown in FIGS. 16–18.

The sequence of operation of this embodiment is illustrated in FIG. 19 which shows a pneumatic control circuitry. The circuit includes a source 178 of air under pressure. Air is directed through regulators 180, 182 through a pair of enabling valves 184, 186. Valves 184, 186 are normally closed and may be operated in unison by a foot pedal 188. Valve 186 admits air directly to the head end of cylinder 48 to drive the clamp 42 downwardly. Cylinder 48 is normally biased in a retracted configuration such as by a spring or other appropriate means. Release of the foot pedal shifts valve 186 to exhaust cylinder 48 thus releasing the clamp. By operating the clamp cylinder 48 in this manner both of the operator's hands are free to manipulate and position the box liner with respect to the toe mold. When the operator is satisfied with the attitude of the box liner, he then actuates each of a pair of valves 190, 192 which are operable from the front of the housing 140. Valves 190, 192 are in connected series and are spaced from each other on the front panel of the housing to require two hand operation thus prompting operator safety. If desired, further safety controls known in the art may be associated with valves 190, 192 to require that they both be released before they are reactivated. Actuation of valves 190, 192 admits air into the head end of cylinder 158 to drive the pressing member 154 downwardly towards the toe box against the toe mold. Actuation of valves 190, 192 also admits air through line 194, through a flow restrictor 196 to a valve 198 to shift the valve 198 from its normally closed configuration. Valve 198 communicates air from the source 178 through regulator 200 and line 202 to the head end of air cylinder 168 to operate the toe hammer arrangement 146. The pilot valve 198 which controls operation of air cylinder 168 is selected so that it will shift in response to a high pressure in cylinder 158 and line 194. That insures that the toe hammer will not operate until after the toe press block 154 has urged the toe box to its fully down position. The flow restrictor 196 in line 194 further insures that there will be a slight delay between operation of air cylinder 158 and air cylinder 168. At any time during the operation of the machine release of the foot pedal 188 will deactivate all cylinders which will return to their retracted configuration.

Figure 20:
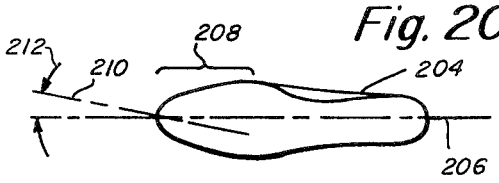
FIG. 20 is an illustration of the bottom of a last showing the angle between the last centerline and the forepart centerline.

FIGS 16–18 also illustrate an improved gaging device for aligning the box liner with the toe mold, both as to longitudinal and lateral positions as well as to facilitate proper angular positioning of the liner with respect to the toe mold. In this regard it should be noted that the forepart portions of a shoe usually is not disposed symmetrically about the centerline of the shoe but, instead, are canted or "gunned" slightly with respect to the more heelwardly disposed portions of the shoe assembly. This is illustrated diagrammatically in FIG. 20 which shows the underside of a right last 204 having a last bottom centerline 206. The forepart region 208 of the last does not lie symmetrically along the last bottom centerline 206, but instead, more nearly lies along a forepart centerline 210 which makes an angle, indicated at 212, with the last bottom centerline 206. When manufacturing the subassembly of the lined box toe, it is desirable that the box liner be oriented with respect to the toe mold (and, therefore, the toe box) to compensate for the angle 212 so that when the more heelward portions of the box liner are attached to the remaining portions of the shoe upper the toe box, box liner and other parts of the upper will be in proper position.

As shown in FIGS. 16–18 the gaging device is located in each of the operating stations of the machine. The gage includes a pair of transversely spaced gage members 214 which are located slightly above the level of the table 142. The gage members 214 are movable in unison in a forward-rearward direction to adjust the general longitudinal position of the box liner. In addition, one of the gage members 216 is movable with respect to the other member 214, in a forward-rearward direction to facilitate proper angular positioning of the box liner to compensate for the angle 212 described above. The gaging members 214, 216 are mounted for such movement by a transversely extending bar 218 located below the table 142. The bar 218 is supported for forward-rearward movement by a pair of longitudinally extending rods 220, 222 secured within the housing below the table 142. The rod 220 is received in a hole formed through the bar 218. The mid-portion of the rod 222 is threaded as indicated at 224 and the threaded portion 224 is received in a threaded hole formed through the bar 218. The rod 222 is rotatably mounted to the housing 140 and may be operated by a knob 226 which is secured to the rearward end of the rod 222 and is accessable at the rear of the housing 140. The gage members 214, 216 are attached to the ends of the bar 218 for forward-rearward movement in unison with the bar to adjust the longitudinal position. Gage member 214 is attached to the bar 218 by a pair of pins 228 which are secured to the bar and extend upwardly through a pair of longitudinal slots 230 formed in the table. The gage member 214 is secured to the upwardly protruding ends of the pins 228. In order to facilitate the longitudinal gaging, the outer end of the gage member 214 moves over a scale plate 232 which has appropriate calibrations formed thereon. If desired, the scale plate 232 may be mounted for longitudinal adjustment on the table 142 by mounting it to a slide 234 which is received in a longitudinal slot 236 formed in the table. The slide 234 can be secured in place by a set screw 238 as shown.

The other gage member 216 is movable in unison with the bar 218 and gage member 214 and also is mounted to the bar 218 for limited adjustable movement, longitudinally, with respect to the bar 218 and gage member 214. This enables the gage members 214, 216 to be spaced slightly, longitudinally, in accordance with the "gunning angle" 212 desired. To this end, the gage member 216 is mounted to a pair of pins 240 which pass upwardly through slots 242 and are secured to a slide 244 mounted to the bar 218, below the table 142. The slide 244 is movable longitudinally in a generally T-shaped slot formed in the bar 218. The slide 244 can be locked in a selected position by a setscrew 246 which is threaded through the underside of the bar 218 and bears against the underside of the slide 244. In the two stationed machine illustrated in FIGS. 16 and 17, which is intended to be set up for use with a right and left shoe, once the position of the gage 216 has been set, that setting will suffice for a wide variety range of shoe sizes and styles. The gaging arrangement also preferably includes a longitudinally extending centering mark 248 at the forward end of the table to facilitate placement of the box liner.

From the foregoing, it will be apparent that the lining of a steel box is simplified considerably and that the resulting lined steel box is of high quality that it is free from wrinkles and is bonded fully and intimately to the surface of the steel box. Moreover, the invention achieves these advantages while at the same time reducing the skill required to properly line steel box toes.

It should be understood, however, that the foregoing description of the invention is intended merely to be illustrative thereof and that other modifications and embodiments may be apparent to those skilled in the art without departing from its spirit.

Having thus described the invention, what we desire to claim and secure by Letters Patent is:

1. A method for lining the inner surface of a rigid box toepiece comprising:

providing a mold having a toe end shaped to substantially conform to the inner surface of the box toepiece;

locating a sheet of lining material on the mold to overlie at least the toe end of the mold;

placing the box toepiece over the toe end of the mold and liner;

sandwiching the liner between the mold and box toe piece to conform the liner to the shape of the inner surface of the box toepiece and to press the liner into substantially continuous contact with the inner surface of the box toepiece; and attaching the liner to the box by an adhesive coating between the box toe piece and the liner.

2. A method as defined in claim 1 wherein said step of attaching the liner to the box toepiece comprises applying a coating of adhesive material to at least one of the inner surface of the box toepiece or the surface of the liner before the box toepiece is placed over the end of the mold and liner.

3. A method as defined in claim 1 wherein said step of sandwiching the liner between the box toepiece and the mold comprises urging the box toe piece simultaneously downwardly and heelwardly with respect to the mold.

4. A method as defined in claim 1 further comprising:

said step of placing the box toepiece comprising locating the box toepiece in an initial position with respect to the mold and in which at least a portion of the lower edge of the box toepiece engages the liner and holds the liner against a portion of the mold;

said step of urging the box toepiece toward the mold comprising urging the box toepiece along a direction which will cause said lower edge thereof to progressively wipe and stretch the liner about the mold as the box toepiece is advanced toward its fully combined position.

5. A method as defined in claim 4 further comprising:

said step of placing the box toepiece including initially orienting the box toepiece on the mold with its toe end extending in an upward and toeward direction and thereafter rotating the toeward end of the box toepiece downwardly while urging the box toepiece heelwardly.

6. A method as defined in claim 1 in which the sheet of lining material includes a rearwardly extending vamp liner portion and wherein said step of locating said sheet with respect to the mold comprises:

providing gage means at a location rearwardly of the mold and orienting rear edge portions of the liner with reference to said gaging means.

7. A method as defined in claim 1 wherein said step of locating said liner comprises:

providing gaging means at a location forwardly of the toe end of the mold and orienting said liner with respect to said forwardly disposed gaging means.

8. A method as defined in claim 1 wherein the box toe piece has an inwardly extending lip along its lower periphery, said step of sandwiching the liner between the box toepiece and the mold comprising:

urging the box toepiece downwardly toward the mold to a position in which the peripheral lip of the box toepiece is disposed below the level of the bottom periphery of the mold; and thereafter urging the box toepiece heelwardly toward the mold to a position in which the lip of the box toepiece underlies the bottom periphery of the mold.

9. A method as defined in claim 8 wherein said box toepiece is urged continually in a downward direction during said heelward urging of the box toepiece.

10. An apparatus for applying a lining to the inner surface of a rigid box toepiece comprising:

a frame;

a mold mounted to the frame and having a toe end substantially conforming in shape to the inner surface of the box toepiece;

gaging means associated with the frame and being cooperative with a selected portion of the liner to enable the liner to be placed on top of the mold and in a desired location and orientation on the mold;

means mounted to the frame for clamping the liner in said position; and pressing means mounted to the frame above the toe end of the mold and being movable toward and away from the toe end of the mold, said press means being so constructed and arranged to urge a box toepiece placed over the liner and toe end of the mold firmly against the toe end of the mold to sandwich the liner between the mold and box toepiece.

11. An apparatus as defined in claim 10 further comprising:

said mold being detachably mounted to the frame.

12. An apparatus as defined in claim 10 further comprising:

said frame including a mold support plate having an upper, mold-supporting surface which is inclined in a forward, upward direction;

a pair of pins secured to and extending upwardly from the mold support plate;

said mold having a pair of holes formed in its lower surface to receive the pins on the mold support plate.

13. An apparatus as defined in claim 12 further comprising:

the upper surface of the mold, at least along its longitudinal center line being substantially horizontal when the mold is in position on the mold support plate.

14. An apparatus as defined in claim 10 wherein said gaging means comprises:

a substantially horizontal table located at substantially the height of the upper surface of the mold and extending rearwardly of the mold, said table being adapted to support the more rearward portions of a sheet of liner material;

said table having indicia formed thereon to facilitate longitudinal and lateral location of the rearward portions of the liner while the more toeward regions of the liner are disposed over the mold.

15. An apparatus as defined in claim 10 wherein said gaging means comprises:

a gaging member located forwardly of the toe end of the mold and being mounted for movement toward and away from the toe end of the mold to various spaced positions with respect to the mold;

said gaging member having an upper end which is located at approximately the same height as the upper surface of the mold and having a shoulder formed thereon at said height to enable a liner to be placed over the mold and to enable the liner to be supported at one end by the mold and at the other end on the shoulder.

16. An apparatus as defined in claim 15 wherein the gaging means further comprises:

a pin secured to the gaging member and extending heelwardly therefrom, the pin being slidably received in a bore formed on the mold support member; and a screw extending parallel to the pin and having its rear end threaded into the mold support member, the other end of the screw being rotatably connected to the gauge to enable the longitudinal position of the gauge to be adjusted by rotation of the screw.

17. An apparatus as defined in claim 16 further comprising:

means defining calibrations on the pin to enable the gauge to be adjusted to a variety of predetermined settings.

18. An apparatus as defined in claim 10 wherein said gaging means comprises:

a table located at substantially the height of the upper surface of the mold and extending rearwardly of the mold, said table being adapted to support the rearward portions of a sheet of liner material;

a pair of transversely spaced gaging members mounted to the table for engagement with the rearwardly disposed, transversely spaced portions of the liner;

said gaging members being mounted for longitudinal movement in unison with each other;

one of said gaging members being mounted for longitudinal movement independently of and with respect to the other of the gaging members.

19. An apparatus as defined in claim 10 wherein said press includes a pressing member at its lower end, said pressing member being constructed and arranged to engage the box toepiece and urge it downwardly and heelwardly.

20. An apparatus as defined in claim 19 wherein said pressing member comprises a plate having a lower, box-engaging surface, said surface being inclined upwardly and rearwardly.

21. An apparatus as defined in claim 10 wherein the clamping means further comprises:

a pad support;

a transversely extending, resilient, clamping pad mounted to the pad support;

a pad support, said pad being secured to the pad support;

said pad support being mounted for pivotal movement about a longitudinally extending axis to facilitate conforming the pad to the shape of the mold.

22. An apparatus as defined in claim 10 wherein said frame further comprises:

a central, heightwise extending frame member;

a mold support secured to the lower end of the central frame member and extending forwardly therefrom;

a bracket secured to and extending forwardly of the upper end of the central frame member and over the mold supporting assembly;

said press being mounted to the outer end of the bracket;

said clamp being mounted to the bracket between the central frame member and the press.

23. An apparatus as defined in claim 10 wherein said press further comprises:

a downwardly extending finger and a downwardly extending pressing foot movable in unison toward and away from the toe end of the mold, said pressing foot being pivotally mounted with respect to the finger;

said pressing foot being engageable with the box toepiece when said pressing means is urged toward the box toepiece to urge the box toepiece downwardly against the mold;

means for restraining pivotal movement of the pressing foot while it urges the box toepiece downwardly against the mold and for thereafter permitting pivotal movement of the pressing foot in a heelward direction;

the lower end of the finger being inclined upwardly and heelwardly to define a wedge-like surface engageable with the toe end of the boxed toepiece to drive the box toepiece in a heelward direction in response to further downward movement of the pressing means.

24. An apparatus as defined in claim 23 further comprising means for biasing the pressing foot downwardly during its heelward pivotal motion.

25. An apparatus as defined in claim 10 wherein said press comprises:

a pressing member mounted to the lower end of the pressing means for engagement with the box toepiece to urge the box toepiece downwardly about the toe mold;

a toe hammer mounted to the frame and being disposed forwardly of the toe end of the mold, the toe hammer being movable toward and away from the toe end of the mold in a generally forward-rearward direction;

drive means for operating the toe hammer;

means for driving the toe hammer in a rearward direction after the toe press has urged the box toepiece downwardly about the toe mold.

26. An apparatus as defined in claim 25 wherein the pressing member is formed from a material having a relatively low coefficient friction to facilitate heelward sliding of the box toepiece in response to operation of the toe hammer.

27. An apparatus as defined in claim 25 further comprising:

control means for delaying operation of the toe hammer until after the toe press has urged the box toepiece to its fully down position on the toe mold.

28. An apparatus as defined in claim 27 wherein the control means further comprises:

pneumatic drive means for operating the toe press;

pneumatic drive means for operating the toe hammer;

valve means for controlling operation of the toe hammer drive means, said valve means being constructed and arranged to be operable in response to a predetermined pressure level in said pneumatic drive means associated with the toe press.

* * * * *